US010805750B2

(12) United States Patent
Audfray

(10) Patent No.: US 10,805,750 B2
(45) Date of Patent: Oct. 13, 2020

(54) SELF-CALIBRATING MULTIPLE LOW FREQUENCY SPEAKER SYSTEM

(71) Applicant: DOLBY LABORATORIES LICENSING CORPORATION, San Francisco, CA (US)

(72) Inventor: Remi S. Audfray, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/381,255

(22) Filed: Apr. 11, 2019

(65) Prior Publication Data

US 2019/0320275 A1 Oct. 17, 2019

Related U.S. Application Data

(60) Provisional application No. 62/656,483, filed on Apr. 12, 2018.

(30) Foreign Application Priority Data

May 28, 2018 (EP) ..... 18174559

(51) Int. Cl.
*H04R 29/00* (2006.01)
*H04R 3/12* (2006.01)

(52) U.S. Cl.
CPC ..... *H04R 29/001* (2013.01); *H04R 3/12* (2013.01)

(58) Field of Classification Search
CPC ..... H04R 3/04; H04R 3/12; H04R 29/001; H04R 29/00; H04R 29/004; H04R 2400/01; H04R 27/00; H04S 7/301; H04S 2400/07; H04S 7/307
USPC ..... 381/307, 59, 96, 58, 94.1, 94.2
See application file for complete search history.

(56) References Cited

U.S. PATENT DOCUMENTS

| | | | | |
|---|---|---|---|---|
| 8,577,048 | B2 | 11/2013 | Chaikin | |
| 9,094,768 | B2 | 7/2015 | Labosco | |
| 2012/0288124 | A1* | 11/2012 | Fejzo | H04R 5/02 381/303 |

(Continued)

FOREIGN PATENT DOCUMENTS

| | | |
|---|---|---|
| EP | 1651007 | 4/2006 |
| WO | 2008/040096 | 4/2008 |

OTHER PUBLICATIONS

Markus Mehlau,"Multiple Subwoofer after Geddes" https://mehlau.net/audio/multisub_geddes/.

(Continued)

*Primary Examiner* — Ahmad F. Matar
*Assistant Examiner* — Sabrina Diaz

(57) ABSTRACT

Embodiments are directed to a speaker system that contains multiple low frequency speakers distributed within a room. Each speaker has at least one driver capable of adequate bass response and an integrated microphone and on-board power and digital signal processing capability. The system has a central sound processor that performs a measurement and calibration process for all of the speakers in the room by receiving test signals from the speakers, measuring certain audio characteristics, deriving audio processing coefficients to smooth the bass response, and transmitting the respective coefficients to each speaker for application to the input audio signals for playback.

14 Claims, 9 Drawing Sheets

(56) References Cited

U.S. PATENT DOCUMENTS

| | | | | |
|---|---|---|---|---|
| 2015/0215723 | A1 | 7/2015 | Carlsson | |
| 2019/0103849 | A1 * | 4/2019 | Shaya | H03G 5/165 |

OTHER PUBLICATIONS

Earl Geddes, "Setting up subwoofers" http://www.gedlee.com/Papers/Setting%20up%20subwoofers.pdf.
"Comparing the MC-12HD and RV-5/MV-5 EQ Calibrations" LEXICON; http://goo.gl/xLEU2g.

* cited by examiner

SELF-CALIBRATING MULTIPLE LOW FREQUENCY SPEAKER SYSTEM

CROSS-REFERENCE TO RELATED APPLICATIONS

This application claims priority to U.S. provisional patent application No. 62/656,483 filed Apr. 12, 2018 and European Patent Application No. 18174559.7 filed May 28, 2018, which are hereby incorporated by reference in their entirety.

FIELD OF THE INVENTION

One or more implementations relate generally to audio speaker systems, and more specifically to self-calibrating low-frequency speakers.

BACKGROUND

Home theatre systems are typically built around multiple speakers in a 5.1, 7.1, or similar speaker configuration with a number (e.g., 5 or 7) of front/rear and surround speaker and a subwoofer or LFE (low frequency effects) speaker as the "0.1" speaker. Such systems are often deployed in a living room or other enclosed listening environment that is characterized by relatively small size (e.g., standard living room size vs. auditorium), non-optimal acoustic characteristics, and an assortment of reflective surfaces such as furniture, and so on.

A challenge of setting up audio systems in small residential spaces (living room, bedroom, etc.) is that the dimensions of the rooms are typically of the same order as the wavelength of low frequency sound in the audible range. This means there are strong resonances (or room modes), which end up dominating the low frequency response in the room. Room modes are the natural resonance frequencies of a room and are created for instance when a sound wave travels between two opposite surfaces, such as the side walls or floor and ceiling. These room modes are the main cause of acoustic distortion in the low frequency range and can create audible problems such as boominess. It should be noted that in general, opposite surfaces in a room only cover the case of axial room modes, and there are also tangential and oblique modes involving more surfaces.

Various different solutions have been proposed to address room mode distortion, such as using dedicated calibration equipment (to address the problem in-situ) or FEA (finite element analysis) techniques (to address the problem at the design phase before the room is built). However, such approaches are can be quite complex, expensive, and require the involvement of one or more experts to calibrate the system.

What is needed, therefore, is a way to improve low frequency performance of home audio systems by using multiple active loudspeakers in the room.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to overcome room mode resonance in the low-frequency range for speakers distributed in a room. A speaker system contains multiple low frequency speakers distributed within a room. Each speaker has at least one driver capable of adequate bass response and an integrated microphone and on-board power and digital signal processing capability. The system has a central sound processor that performs a measurement and calibration process for all of the speakers in the room by receiving test signals from the speakers, measuring certain audio characteristics, deriving audio processing coefficients to smooth the bass response, and transmitting the respective coefficients to each speaker for application to the input audio signals for playback.

Embodiments are further directed to a method of improving low-frequency audio response of speakers in a room by: playing, from each speaker, a low frequency test signal to the other speakers, wherein each speaker has a microphone; synchronously measuring, in a measurement step, a resulting sound pressure in the room at all speakers by computing an impulse response of each speaker in a sound processor by measuring a transfer function from the speakers; computing, in a calibration step, a sound pressure level at each speaker position resulting from playing combinations of the speakers together; and minimizing a cost function of sound pressure variation across speaker positions versus spectral distortion at each speaker.

Embodiments are yet further directed to a method of improving low-frequency audio response of speakers in a room, wherein each speaker has an integrated microphone, by measuring a plurality of acoustic characteristics for each speaker as measured by a corresponding microphone of the speakers; computing a calibration coefficients for each measured acoustic characteristic; and applying each calibration coefficient to a speaker signal to minimize a difference in transfer functions for each of the corresponding microphones to smooth a bass response of the speakers in the room. The acoustic characteristics comprise gain, delay, equalization, and polarity, and the calibration coefficients may be applied to individual speaker signals in an audio file processing surround-sound audio content, as part of a bass management process. In this embodiment, the low frequency part of all channels is downmixed into the input of an optimized low frequency playback process.

Embodiments are yet further directed to a speaker system having a plurality of individual low-frequency speakers distributed in a room, wherein each speaker has one or more drivers and an integrated microphone, a wired or wireless interface to a central sound processor, a battery, and an internal digital signal processor; and a central processor that is configured to perform any of the methods described above in this Summary section.

Embodiments are yet further directed to methods of making and using or deploying the speakers, circuits, and driver designs that optimize the rendering and playback of stereo, surround, or immersive sound content using processing circuits and certain acoustic design guidelines for use in an audio playback system.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1:
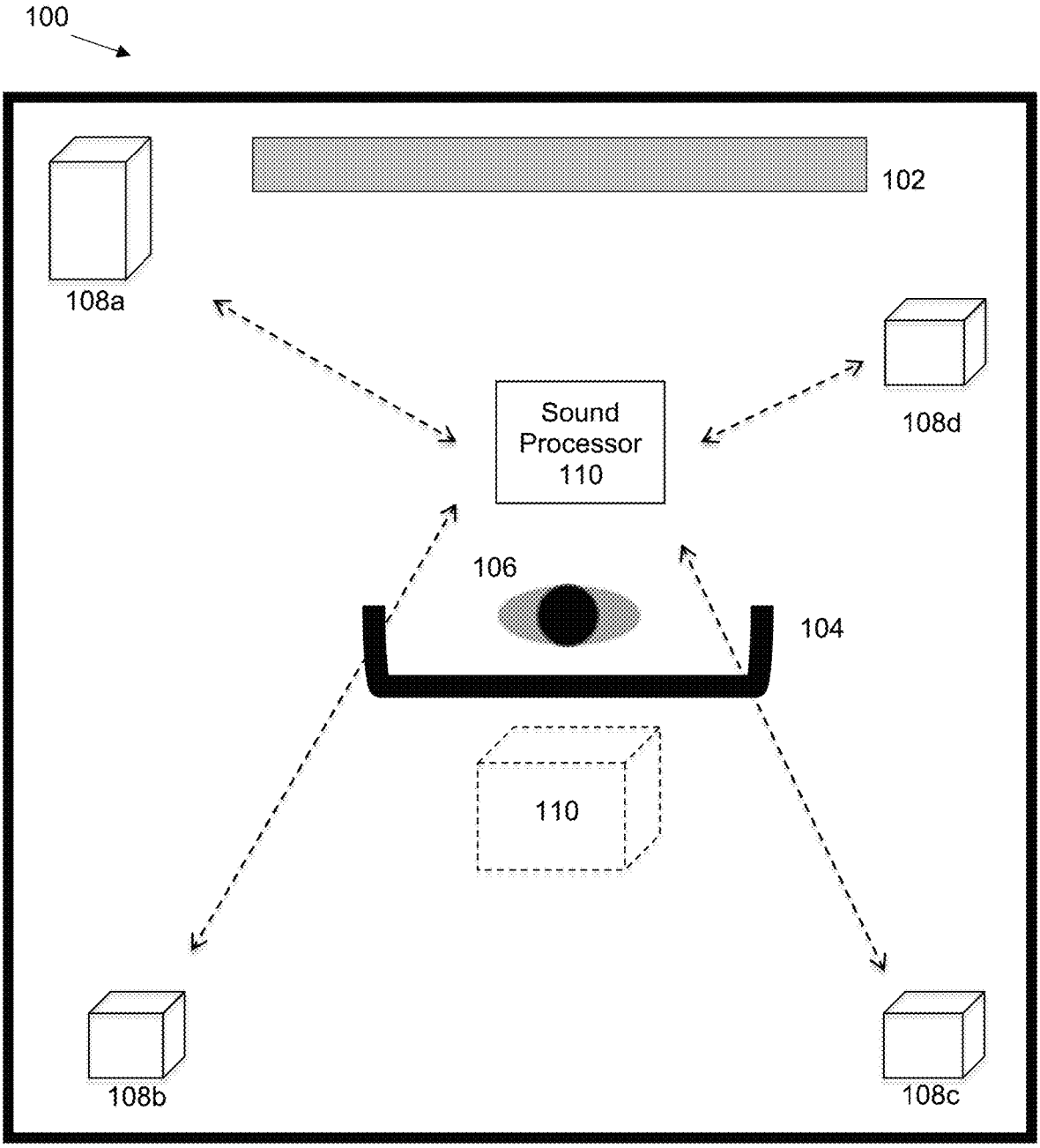
FIG. 1 illustrates a multi-speaker system to overcome room modes under some embodiments.

Systems and methods are described for a multi-way portable loudspeaker that has multiple subwoofers and microphones to overcome room mode resonance in the low-frequency range for playback of multi-channel audio content. Aspects of the one or more embodiments described herein may be implemented in or used in conjunction with an audio or audio-visual (AV) system that processes source audio information in a mixing, rendering and playback system that includes one or more computers or processing devices executing software instructions.

Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on (i.e., a collection of channels as just defined); the term "object" means one or more audio channels with a parametric source description, such as apparent source position (e.g., 3D coordinates), apparent source width, etc.; "object-based audio" means a collection of objects as just defined; and "immersive audio," (alternatively "spatial audio") means channel-based and object or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content. The term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure, and the terms "cabinet" or "housing" mean the unitary enclosure that encloses one or more drivers. The terms "driver" and "speaker" may be used interchangeably when referring to a single-driver speaker. The terms "speaker feed" or "speaker feeds" may mean an audio signal sent from an audio renderer to a speaker for sound playback through one or more drivers.

Embodiments are directed to loudspeakers or speaker systems for use in sound rendering system that is configured to work with various sound formats including monophonic, stereo, and multi-channel (surround sound) formats. Another possible sound format and processing system may be referred to as an "immersive audio system," or "spatial audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio and object-based audio. Such a combined approach provides greater coding efficiency and rendering flexibility compared to either channel-based or object-based approaches taken separately.

Multi-Speaker System

As described above, the low-frequency response of audio systems suffers in certain listening environments due to the room mode resonances, which causes uneven or distorted low frequencies across the room. In an embodiment, a multi-speaker system has certain design elements to overcome this problem. FIG. 1 illustrates a multi-speaker system to overcome room modes under some embodiments. FIG. 1 shows a plan view of a typical listening environment, such as a living room or similar room that has a central listening location facing a television 102, screen, or other focal point. A couch 104, chair, or similar sitting area is located in the approximate center of the room for positioning a listener (user) 106 in an optimal viewing and listening position. A typical home audio or surround sound stereo system may have a pair of stereo speakers or an array of surround sound speakers (e.g., 5.1 or 7.1) front and surround sound speakers as well as one subwoofer. The subwoofer speaker is typically quite large compared to the other speakers, and thus placement may sometimes be an issue to ensure it is not in the way or takes up too much space within the room. For the example of FIG. 1, the optimum placement of a subwoofer for acoustic effects may be in the center of the room, right near or coincident to the optimum listening/viewing position 104, and such a subwoofer should be relatively large. Thus, as shown in FIG. 1, imaginary subwoofer 110 represents an advantageous location. However, this may be a problem for practical room layouts as it takes up valuable space right in the middle of the room and may represent an obstacle or unsightly object.

In an embodiment, the low-frequency speaker function is provided by a number of smaller speakers that are arrayed throughout the room and perform certain audio processing techniques to minimize the coupling with individual acoustic room resonance. As shown for the embodiment of FIG. 1, the multi-speaker system 100 comprises a number of low-frequency (subwoofer) speakers 108*a-d* distributed throughout a room as well as a central processing unit. The example of FIG. 1 illustrates four speakers denoted 108*a*, 108*b*, 108*c*, and 108*d* positioned near the side or corners of the room (standard stereo and surround speakers are not shown). The number and position of the speakers is not limited to the configuration shown and may change depending on the constraints and characteristics of the system and room. The speakers may be identical or they may be different from one another, and at least one may comprise the LFE (0.1) speaker in a surround sound system.

Figure 2:
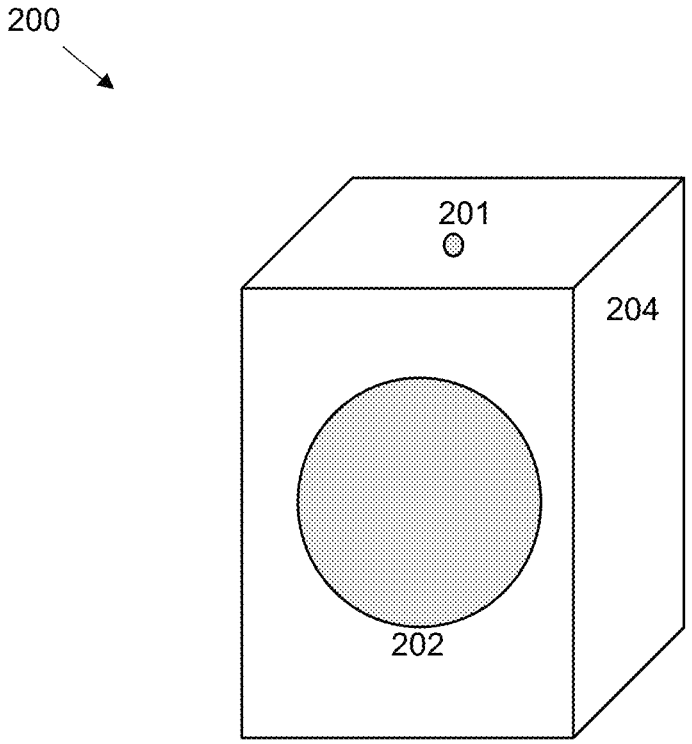
FIG. 2 illustrates an example of a simple speaker for use in the system of FIG. 1 under some embodiments.

The configuration of each speaker may be different, but each speaker basically comprises an enclosure or box containing a driver and additional audio processing components. FIG. 2 illustrates an example of a simple speaker for use in the system of FIG. 1 under some embodiments. FIG. 2 illustrates an exterior view of the speaker having an enclosure 204, a driver 202, and a microphone 201. The size and shape of the speaker may be configured in any number of ways depending on the size of the room and the audio playback requirements. Likewise, the size and number of drivers, as well as their orientation on any of the enclosure faces of the cabinet 204 may change. The microphone or microphone array may be provided in a port of the speaker or in an exterior mounting, or any other appropriate configuration. In general, a larger cabinet and driver (e.g., >6") will provide greater low-frequency response, but smaller drivers and enclosures may also be used under some embodiments. In an embodiment, the driver 202 comprises a woofer or large mid-range speaker that provides adequate low-frequency playback for bass response. A single driver may be provided or a coaxial arrangement of a woofer and midrange, or preferably a subwoofer and woofer driver may be used. Depending on speaker constraints, other driver configurations and sizes are also possible.

Figure 3:
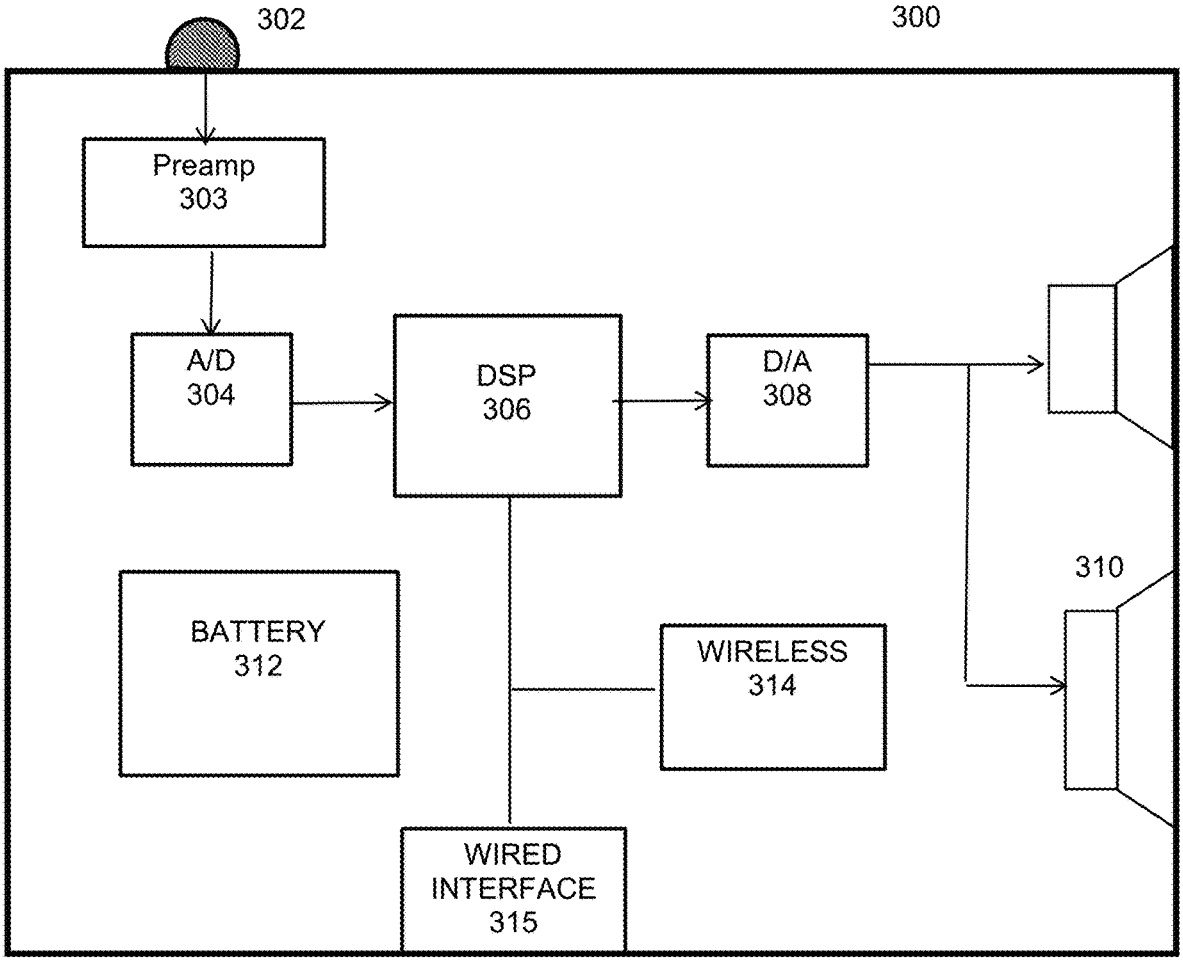
FIG. 3 is a circuit diagram illustrating the composition of a speaker for use in the system of FIG. 1 under some embodiments.

FIG. 3 is a circuit diagram illustrating the composition of a speaker for use in the system of FIG. 1 under some embodiments. Each speaker contains one or more drivers (transducers) 310 for audio playback and one or more microphones 303 and mic preamps 304 for picking up test signals. The microphone output is provided to an A/D (analog-to-digital) converter 304 and input to a DSP (digital signal processor) for audio processing. The DSP output is then sent to a D/A (digital-to-analog) converter for generation of audio signals that are output through the speaker or speakers 310. An optional wireless module 314 or wired interface 315 is provided for communication to a central processor (e.g., sound processor 110, and an on-board power supply or battery 312. Other circuits and components may be included as needed for specific configurations and uses. Alternatively, the components of FIG. 3 may be integrated into fewer or multiple other components as required.

For the example of FIG. 1, the speakers 108*a-d* are controlled through a central sound processor component 110. Such a sound processor may be embodied as a circuit provided separately and placed anywhere within the room as a standalone unit, or as a component within one of the speakers 108*a*-108*d*, which may function as a controlling speaker. Alternatively, the sound processor 110 may be embodied as a component within another audio component, such an A/V receiver, cable box, media player, and so on. It may also be provided as a computer or mobile phone application controlled by a laptop or phone device held by the user 106. Thus, the system could be augmented by an application running on a mobile device equipped with a microphone, and wirelessly connected to the system. Other similar implementations of the sound processor 110 are also possible.

As shown in FIG. 1, all of the speakers 108*a-d* have a wired or wireless connection to the central processing unit for audio signals as well as other data (measurement data, filter coefficients, etc.). The wired 315 or wireless 314 interface of each individual speaker 300 communicates with the central sound processor component 110 to pass audio control information from the sound processor to the respective speakers. In an embodiment, speaker system 100 performs a measurement and calibration process for all of the speakers 108*a-d* in the room by receiving test signals from the speakers, measuring certain audio characteristics, deriving audio processing coefficients to smooth the bass response, and transmitting the respective coefficients to each speaker for application to the input audio signals for playback.

Figure 4:
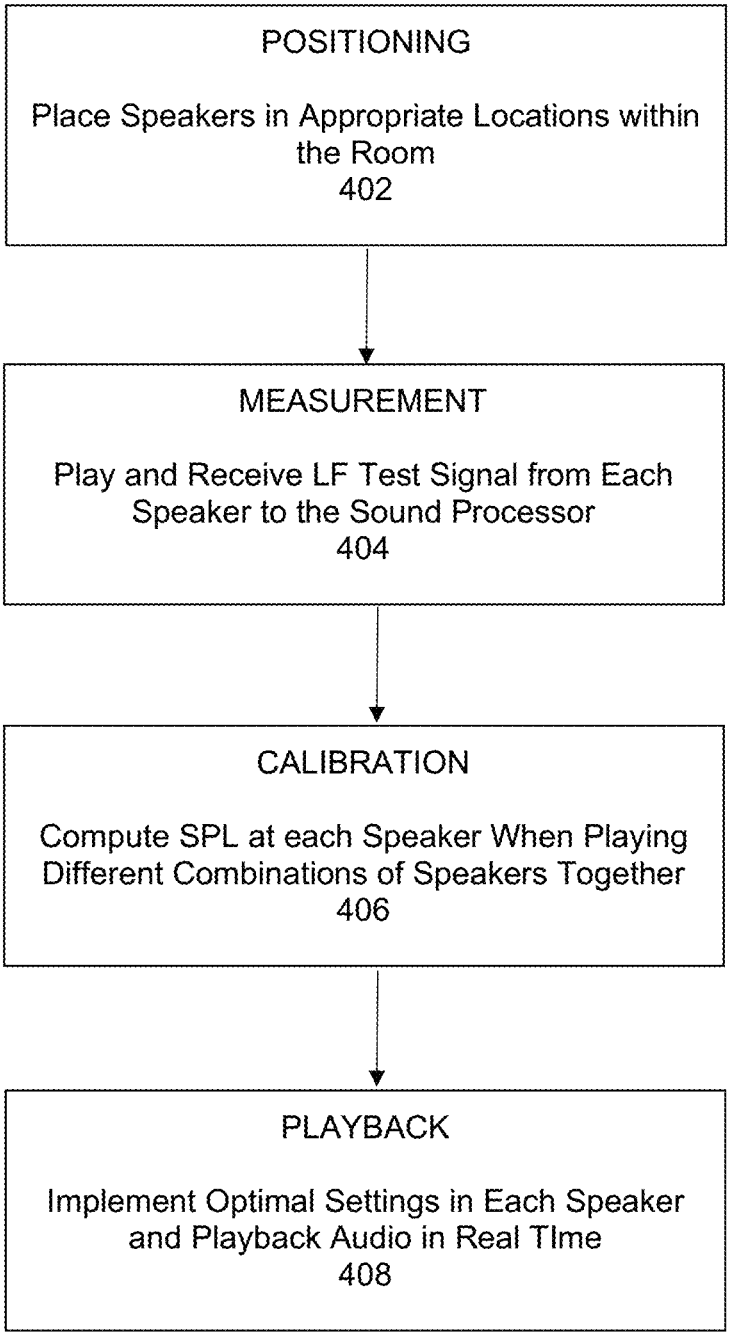
FIG. 4 is a flowchart illustrating an overall method of performing multi-speaker playback of low frequency sound to overcome room modes under some embodiments.

FIG. 4 is a flowchart illustrating an overall method of performing multi-speaker playback of low frequency sound to overcome room modes under some embodiments. For the process of FIG. 4, the speakers are placed in appropriate locations with the room, block 402. The speakers may be placed deliberately in locations and orientations intended to project sound in an optimum way to provide good bass response, or they may be placed relatively randomly in the room or in a way meant to minimize obstructions and visual clutter. In general, the speakers may be initially placed and then moved throughout the process to modify the resulting sound patterns; however, in a typical usage case, they are initially placed in less obtrusive locations and moved only slightly if at all.

Once placed, the speakers are set up for use in an initial setup and measurement step 404. During setup, each speaker plays a low frequency test signal (e.g. a log swept sine wave). The resulting pressure in the room is synchronously measured at all the speakers (including the one playing its own test signal) through their integrated microphones 302 and stored for analysis. The resulting impulse response for each speaker is computed in the central sound processor 110 using deconvolution, or similar, techniques. The system operates by measuring the transfer function from the speakers. In an embodiment, the impulse response is computed through a standard system of measuring and representing SPL versus frequency where the impulse response (IR) and its associated Fourier transform, the complex transfer function (TF), describe the linear transmission properties of any system able to transport or transform energy in a certain frequency range. As the name suggests, the IR is the response in time at the output of a system under test when an infinitely narrow impulse is fed into its input.

After the measurement phase, the system performs a calibration step, 406. This consists of computing the sound pressure level at each loudspeaker position, resulting from playing combinations of the loudspeakers together. First, all the loudspeakers are time aligned based on their relative distance to the listener. If the listener position is not known, a predefined position can be assumed (e.g., the center of the room). Then, the sound pressure level at each loudspeaker position is computed by adding the complex response of each loudspeakers with varying amounts of gain, and polarity changes. An optimization layer is used to guide the search for the best combination of settings. The cost function to be minimized is a combination of the sound pressure variation across the loudspeaker positions, and the spectral distortion at each loudspeaker. Lowering those parameters is expected to lower the excitation of room resonances. This is likely to lead to the most accurate low frequency sound reproduction by the playback system.

Once the optimal settings have been computed, they are implemented in a playback step 408 for each speaker. The parameters are applied to the audio signal fed to each speaker, and this can be implemented either in the central processing unit 110, or in each speaker's DSP 306. The audio signal thus gets processed in real-time during playback, and the bass response for the room is tailored by the coefficients generated by the calibration process 406.

Figure 5:
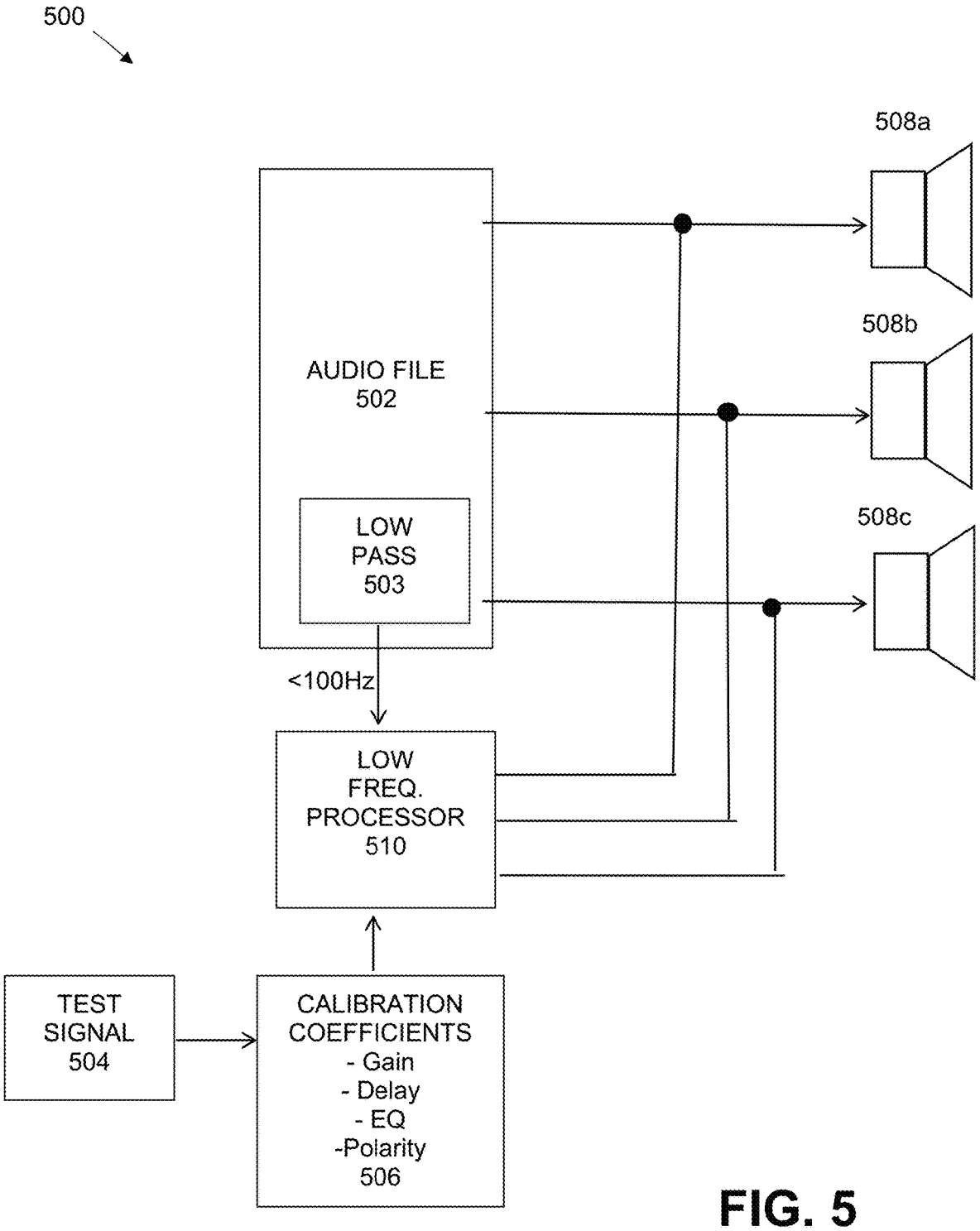
FIG. 5 is a diagram that illustrates the application of calibration coefficient to speaker feeds under some embodiments.

FIG. 5 is a diagram that illustrates the application of calibration coefficient to speaker feeds under some embodiments. As shown in diagram 500 of FIG. 5, an audio file 502 provides individual speaker signals to respective low-frequency speakers 508*a-c*. Though three speakers are shown, any practical number of speakers may be provided, and the speakers 508*a-c* may be individual speakers, such as shown as elements 108*a-d* in FIG. 1, or they may be combinations of individual drivers within two or more separate speaker cabinets. The audio file 502 may represent the low-frequency content of an entire full-spectrum audio file, or it may be the low-pass filtered speaker signals from an entire full-spectrum audio file, or any other appropriate file for an audio source with low-frequency content. The low-frequency content may comprise any audio content below a threshold frequency, such as 100 Hz, 200 Hz or other similar frequency in the audio spectrum (20 to 20 KHz). This low frequency content is down-mixed into one channel as shown in FIG. 5 where a low-pass filter 503 passes the low-frequency content (e.g., below 100 Hz) to the low frequency processor 510.

The low frequency processor 510 generates speaker signals from the down-mixed signal and transmits respective speaker signals to each respective speaker. Thus, as shown in diagram 500, each speaker 508*a-c* receives the down-mixed signal generated from the audio file 502 through low frequency processor 510. A test signal generated by each speaker 508*a-c* is used in test signal processing component 504 and the result is used to produce calibration coefficients 506. The calibration coefficients 506 are then fed back through the low frequency processor 510 to the individual speaker signals to modify the signal to each speaker. In an embodiment, the calibration coefficients comprise values that modify the audio characteristics of gain, delay, equalization, and polarity of each speaker signal. Embodiments are not so limited, however, and other or additional audio characteristics may also be assigned coefficient values to modify the speaker signals.

Figure 6:
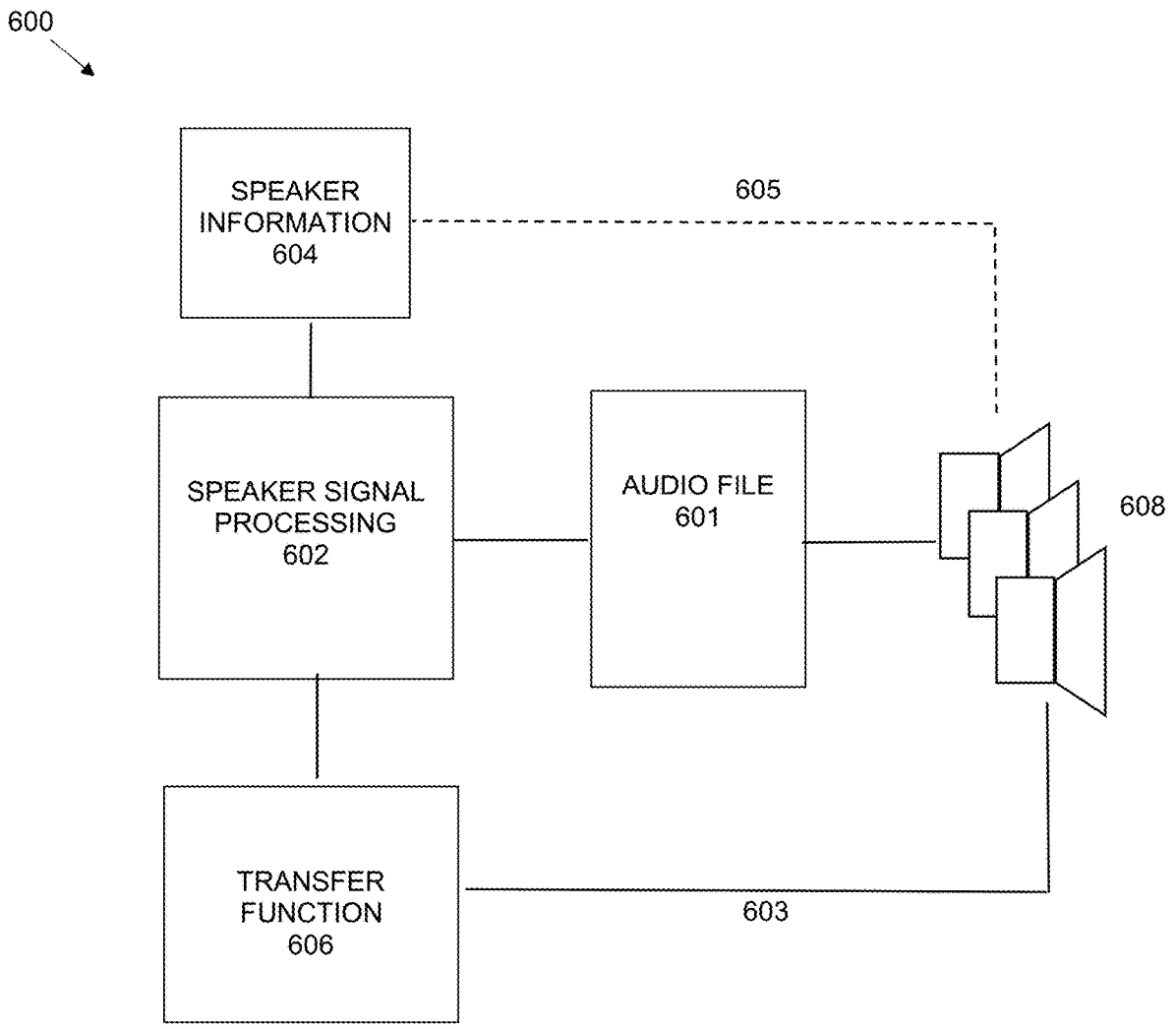
FIG. 6 illustrates the composition of speaker processing signals to modify an audio file for low-frequency playback under some embodiments.

FIG. 6 illustrates the composition of speaker processing signals to modify an audio file for low-frequency playback under some embodiments. As shown in diagram 600, a speaker signal processing block 602 provides signals to audio file 601 to modify speaker signals sent to the individual low-frequency speakers 608. As shown in FIG. 6, signals provided by speakers 608, such as through the impulse response data generated by the test signals are provided through link 603 to generate a set of transfer functions 606 that are used by the processor to generate the appropriate calibration coefficients. In an embodiment, the transfer functions are compiled by all of the possible speaker/microphone combinations available for all of the speakers in the room, such as speakers 108*a-d* in room 100 of FIG. 1. Each speaker outputs a test signal that is picked up by each of the other speaker microphones, including its own. Thus, in a case where each speaker has a single integrated microphone, for the speakers (S) and microphones (M). The transfer functions can be expressed as a combination of each speaker microphone pair as follows:

$$\begin{matrix} S_1M_1 & S_2M_1 & S_3M_1 & \dots & S_NM_1 \\ S_1M_2 & S_2M_2 & S_3M_2 & \dots & S_NM_2 \\ \dots & \dots & \dots & \dots & \dots \\ S_1M_N & S_2M_N & S_3M_1 & \dots & S_NM_N \end{matrix}$$

For the above example there are $N^2$ possible transfer function combinations. If the number of microphones exceeds the number of speakers, such as through multiple microphone arrays, the different combinations can be expressed accordingly. The sum of the transfer functions $S_NM_N$ is provided as the transfer function 606 to the speaker signal processing component 602.

Figure 7:
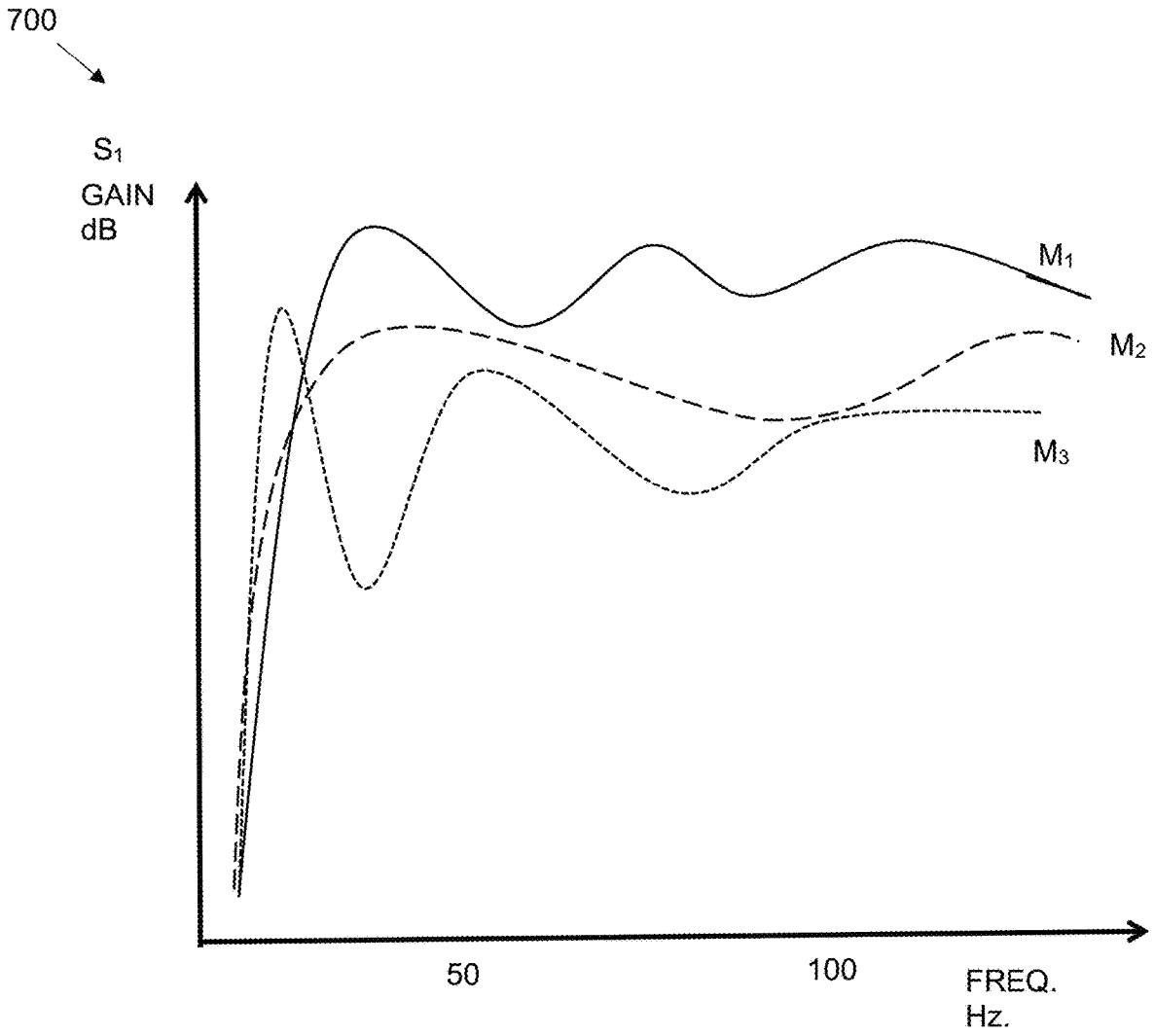
FIG. 7 illustrates a number of different transfer curves for a given speaker as produced by different microphones, under an example embodiment.

Each speaker/microphone combination for the matrix above gives a different transfer curve. This is illustrated in FIG. 7, which shows three different transfer curves for a given speaker ($S_1$) as produced by three different microphones $M_1$, $M_2$, and $M_3$. As shown in diagram 700, the three different microphones generate different transfer curves based on their different locations relative to the speaker $S_1$. Similar sets of transfer functions for all of the microphones $M_1$ to $M_M$ are available for all of the speakers $S_1$ to $S_N$.

In an embodiment, the speaker signal processing component 602 is configured to minimize a cost function associated with the transfer functions. The minimization process comprises minimizes the differences among the different transfer functions for the microphones for each speaker, and between the speakers themselves. The cost function to be minimized thus represents the spatial variation among the transfer functions $S_NM_M$ for N speakers and M microphones. M1 M2 and M3. In an embodiment, the speaker signal processor 602 performs an FFT analysis of the frequency points of the transfer functions, derives the standard deviation, and then averages over the frequencies. Thus, the spatial variation (cost function) is averaged over frequency.

Figure 8:
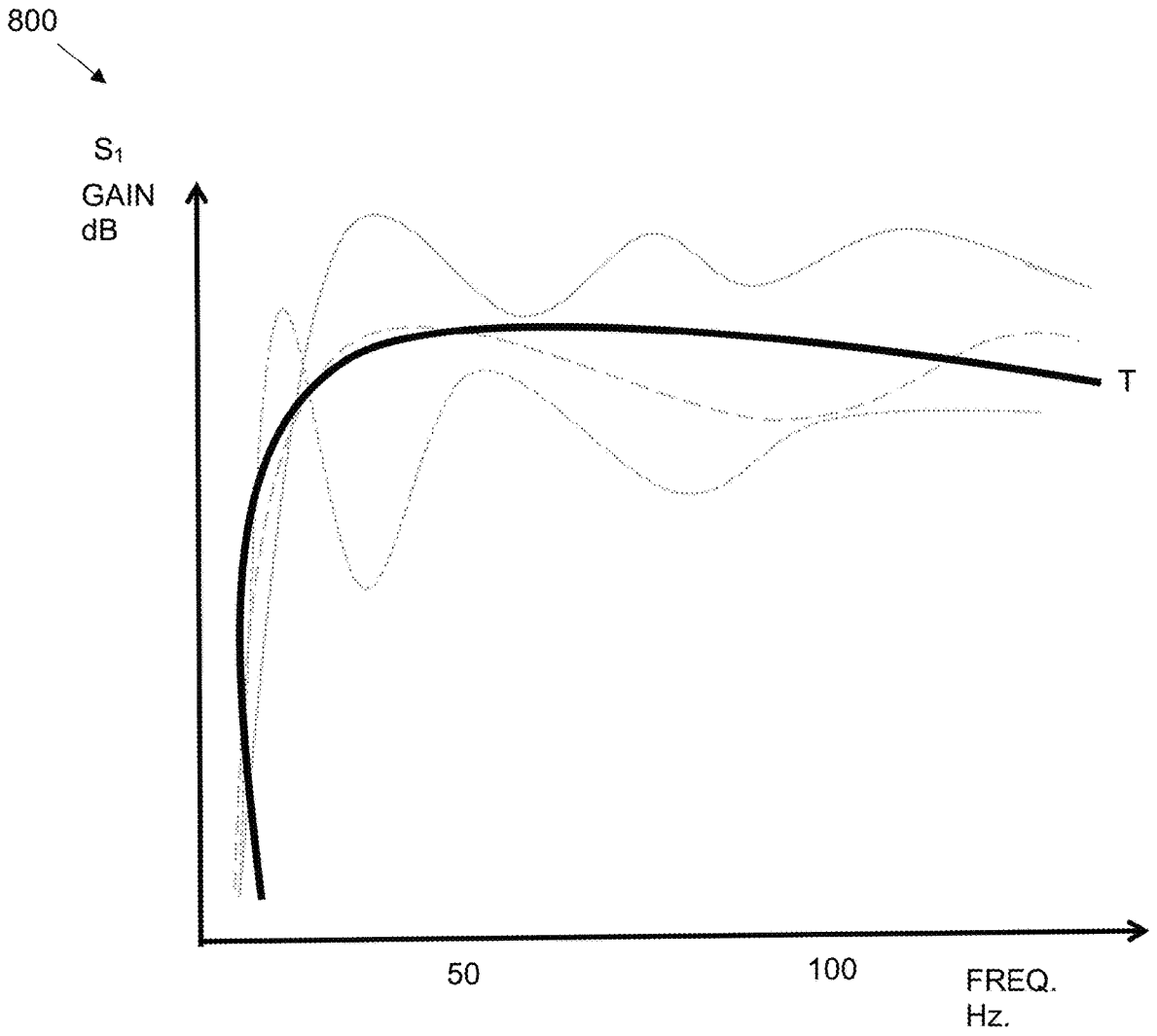
FIG. 8 illustrates a result of an averaging process of the transfer functions of FIG. 7.

FIG. 8 illustrates a result of a summing process of the transfer functions of FIG. 7 under an example embodiment. The resulting curve T can be expressed as: $\Sigma M_N$ for speaker $S_1$.

In an embodiment, the transfer functions are used by the speaker signal processor 602 to generate the calibration coefficients that are input to the audio file 601. Table 1 below lists the calibration coefficients, their respective units of measurement, and example values, under some embodiments.

TABLE 1

| | | |
|---|---|---|
| GAIN | dB | 0-10<br>1 dB increment |
| DELAY | ms | 0 to 50 ms |
| EQ | Q Factor | Q = [1-12] steps |
| | Freq. Range | F = 5-100 Hz |
| | Gain | G = [−6 dB, +6 dB] |
| POLARITY | +/− | |

Figure 9:
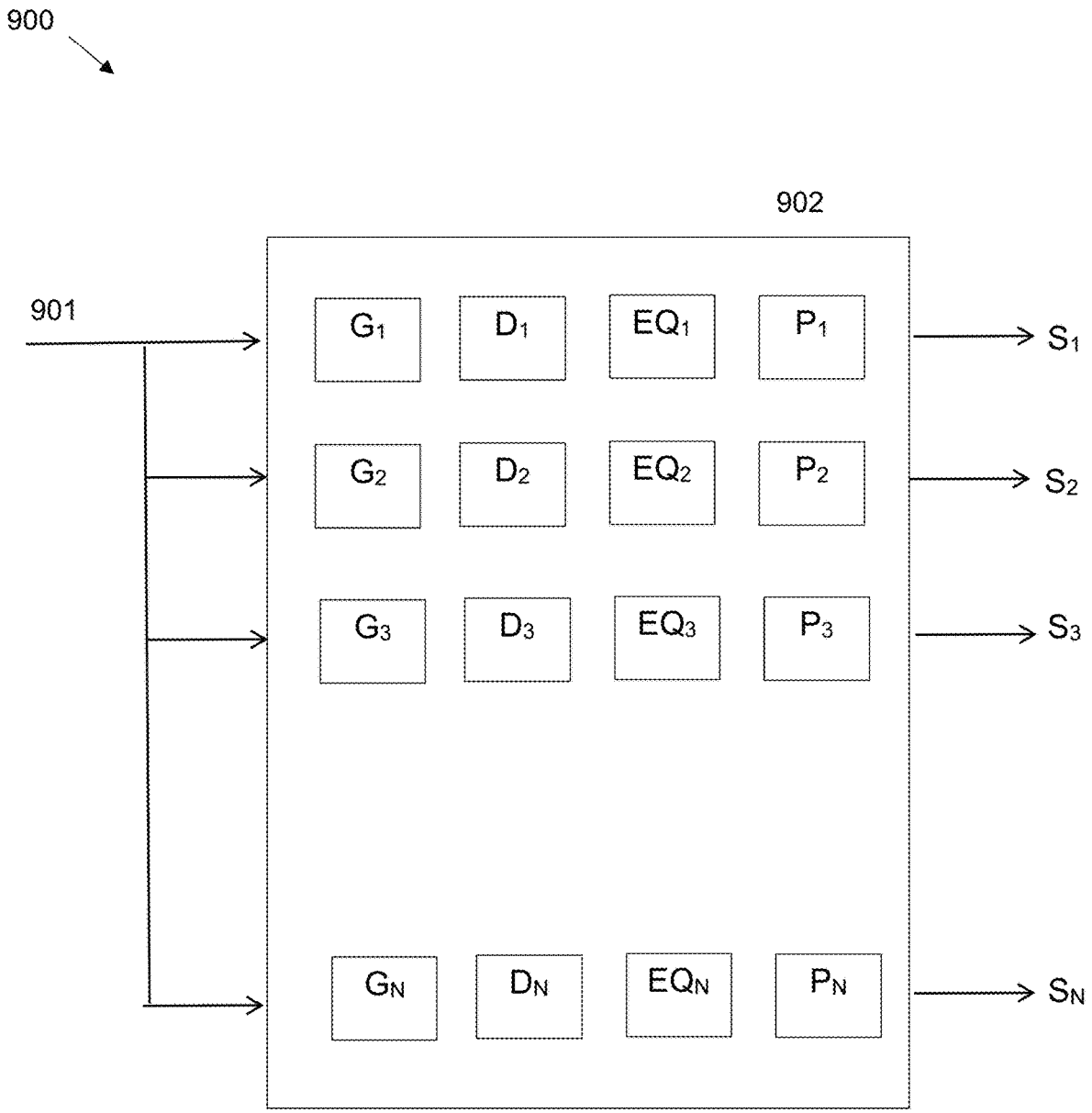
FIG. 9 is a diagram that illustrates generating speaker signals using calibration coefficients under some embodiments.

Each calibration parameter (Gain, Delay, EQ, Polarity) provides a respective value that is used by the sound processor to generate a speaker signal for a corresponding speaker. FIG. 9 illustrates generating speaker signals using calibration coefficients under some embodiments. As shown in diagram 900, an audio input signal 901 having N individual speaker feeds is provided to the processor component 902. For each speaker feed, the corresponding calibration coefficients are applied, as denoted G (gain), D (delay), EQ (Equalization), and P (polarity). The signal with each coefficient applied produces resulting speaker signals $S_1$, $S_2$, $S_3$, to $S_N$.

In an embodiment, the convolution function of the different M curves to produce the final curve may be expressed as:

$$Sig_M=\Sigma[(S_N M_M)*\text{Coefficients } S_n]$$

The calibration coefficients are applied to the speaker signal to minimize the variation of the different transfer curves and thus generate a curve more closely approaching the final average summed curve, T.

For the embodiment of FIG. 6, in certain cases, speaker information 604 may also be used to provide characteristics that are used to modify the speaker signals. Such information can include characteristics such as speaker size, driver configuration and size, power rating, orientation, frequency response, location, and so on. Such information may be manually entered by a user through a setup program or other similar input means, or it may be provided to the central processor through configuration/setup information provided by the speakers themselves (over link 605), such as through an auto-discovery process or similar method.

In a further embodiment, weighting values may be assigned to certain speakers of the array of speakers. For example, the transfer function for a dedicated subwoofer may be weighted more heavily than smaller speakers to reflect the fact that its effect on the low-frequency response in the room may be greater than the other speakers. For this embodiment, the transfer functions 606 provided to the speaker signal processor 602 may be weighted as follows:

$$w_1S_1+w_2S_2+\ldots+w_NS_N$$

where the weights $w_N$ may be assigned a scalar value from 1 to 10 or similar range.

The optimization of response curves may be provided in a machine learning system or similar system. It may also be simply implemented in a brute force approach, by computing every combination possible and retaining the one providing the lowest cost function value.

The self-calibrating process of FIG. 4 may be provided as an automated function that is initiated and controlled by the central sound processor 110 or by a controlling speaker or mobile phone application initiated by the user in a one-touch command type process.

Embodiments of the multi-speaker system provide advantages over present solutions by being a measurement-based approach, as opposed to relying on acoustical modeling. This means that no prior knowledge about the room geometry of surface materials is required. The measurements are done at the subwoofer positions, as opposed to measuring at the listening positions. The positions of the listeners do not necessarily have to be known. It utilized an automated process. There is no need for a professional to go in situ for calibrating the system. The system is self-contained in the woofer or subwoofer speakers themselves, and there is no need for measurement microphones or other dedicated calibration equipment.

In general, each standalone speaker 108*a-d* may be of any appropriate size, shape, driver configuration, build material, and so on, based end use considerations, such as audio processing system, smart speaker or home audio applications, room size, power requirements, portability, and so on.

In an embodiment, the speaker may be coupled to an A/V controller or audio source through a wired or wireless link. For these embodiments, the input audio 102 of FIG. 1 may be provide by an AVR that is coupled to the speakers over a direct wired connection. In the case of a wireless link, the wireless speakers receive the input audio signal wirelessly, instead of receiving an electrical audio signal via a wire. The wireless speakers may connect to the AVR or audio source via a Bluetooth™ connection, a WiFi™ connection, or proprietary connections (e.g., using other radio frequency transmissions), which may (or may not) be based on WiFi™ standards or other standards.

As stated above, the physical dimensions, composition, and configuration of the individual speakers may vary depending on system needs and constraints. The cabinet 204 may be constructed of any appropriate material, such as wood, plastic, medium density fiberboard (MDF), and so on, and may be of any appropriate thickness, such as 0.75 inches.

Besides generation of low-frequency speaker signals to overcome room modes, other processing functions may also be performed by processor 110, such as high or low-pass filtering, crossovers, and so on. In an embodiment, the speaker system may height speakers and include a crossover high-pass filter operation that is performed on the height channels (e.g., denoted as the "0.2" in a 2.1.2 system) to extract all high-frequency content, and perform other height specific processing.

The processing components and audio design guidelines may be provided to speaker or equipment manufacturers/integrators in kit form to help configure existing speaker or smart speaker products.

Any processing components of FIG. 1 may be provided as hardware components that are provided to a device manufacturer for integration into a product, such as through a chipset, dedicated circuit, etc., or as firmware such as in a device level program burned into a programmable array, ASIC (application specific integrated circuit), etc., or as software executed by a processor or co-processor of the device, or any combination of hardware/firmware/software.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

The processing components may be implemented through the use of discrete circuits or programmable devices, such as FPGA (field-programmable gate arrays), ASICs (application specific integrated circuits), and so on.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," and "hereunder" and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of improving low-frequency audio response of speakers in a room, comprising:

playing, from each speaker, a low frequency test signal to the other speakers, wherein each speaker has a microphone;

synchronously measuring, in a measurement step, a resulting sound pressure in the room at all speakers by computing an impulse response of each speaker in a sound processor by measuring a transfer function from the speakers;

computing, in a calibration step, a sound pressure level at each speaker position resulting from playing combinations of the speakers together; and minimizing a cost function of sound pressure variation across speaker positions versus spectral distortion at each speaker.

2. The method of claim 1 wherein the calibration further comprises time aligning all speakers based on their relative distance to a listener or a predefined position in the room; and computing a sound pressure level at each speaker position by adding a complex response of each speaker with varying amounts of gain, and polarity changes using an optimization layer find an optimum combination of settings.

3. The method of claim 1 wherein the cost function is minimized by lowering the sound pressure variation and the spectral distortion to lower excitation of room resonances to provide accurate low frequency sound reproduction by an audio playback system.

4. The method of claim 3 further comprising:

implementing optimized settings in one of: a central sound processor or digital signal processing (DSP) component in each speaker; and processing the audio with the optimized settings in real-time during playback.

5. The method of claim 1 wherein the test signal comprises a log swept sine wave, and wherein the impulse response is measured using deconvolution techniques.

6. The method of claim 1 wherein the calibration step generates calibration coefficients comprising values that modify the audio characteristics of gain, delay, equalization, and polarity of each speaker signal.

7. The method of claim 6 wherein the cost function is minimized by applying the calibration coefficients to each speaker signal.

8. The method of claim 7 wherein the cost function comprises a spatial variation of frequency response curves in a low-frequency portion of the audio spectrum for each speaker and microphone pair.

9. A method of improving low-frequency audio response of speakers in a room, wherein each speaker has an integrated microphone, comprising:

measuring, in response to a low frequency test signal, a room sound pressure at each speaker as measured by a corresponding microphone in each speaker and computed by an impulse response measured by a transfer function of the speakers from a sound pressure level at each speaker position resulting from playing combinations of the speakers together;

computing calibration coefficients for each measured acoustic characteristic; and applying each calibration coefficient to a speaker signal to minimize a difference in transfer functions for each of the corresponding microphones to smooth a bass response of the speakers in the room.

10. The method of claim 9 wherein the acoustic characteristics comprise gain, delay, equalization, and polarity.

11. The method of claim 10 wherein the calibration coefficients are applied to individual speaker signals in an audio file processing surround-sound audio content.

12. A speaker system comprising:

a plurality of individual low-frequency speakers distributed in a room, wherein each speaker has one or more drivers and an integrated microphone, an interface to one or more processors; and a central sound processor playing, from each speaker, a low frequency test signal to the other speakers, synchronously measuring a resulting sound pressure in the room at all speakers by computing an impulse response of each speaker by measuring a transfer function from the speakers, computing a sound pressure level at each speaker position resulting from playing combinations of the speakers together, and minimizing a cost function of sound pressure variation across speaker positions versus spectral distortion at each speaker.

13. The speaker system of claim 12 wherein the interface comprises one of a wired or wireless interface to the central sound processor.

14. The speaker system of claim 13 wherein the central sound processor is one of:

a dedicated standalone device, a component within a speaker of the speaker system, and an executable application resident on a portable device operated by a user.

* * * * *